US012628875B2

(12) United States Patent
Qiu

(10) Patent No.: US 12,628,875 B2
(45) Date of Patent: May 19, 2026

(54) AEROSOL GENERATION DEVICE

(71) Applicant: CHANGZHOU PATENT ELECTRONIC TECHNOLOGY CO., LTD., Changzhou City (CN)

(72) Inventor: Weihua Qiu, Changzhou City (CN)

(73) Assignee: CHANGZHOU PATENT ELECTRONIC TECHNOLOGY CO., LTD., Changzhou City (CN)

( * ) Notice: Subject to any disclaimer, the term of this patent is extended or adjusted under 35 U.S.C. 154(b) by 575 days.

(21) Appl. No.: 18/070,449

(22) Filed: Nov. 28, 2022

(65) Prior Publication Data

US 2023/0091872 A1 Mar. 23, 2023

Related U.S. Application Data

(63) Continuation-in-part of application No. PCT/CN2021/092565, filed on May 10, 2021.

(30) Foreign Application Priority Data

May 27, 2020 (CN) ..... 202020928409.0

(51) Int. Cl.

| | |
|---|---|
| ***A24F 40/51*** | (2020.01) |
| ***A24F 7/00*** | (2006.01) |
| ***A24F 40/10*** | (2020.01) |
| ***A24F 40/40*** | (2020.01) |
| ***A24F 40/42*** | (2020.01) |

(Continued)

(52) U.S. Cl.

CPC ..... *A24F 40/51* (2020.01); *A24F 7/00* (2013.01); *A24F 40/10* (2020.01); *A24F 40/40* (2020.01); *A24F 40/42* (2020.01); *A24F 40/44* (2020.01); *A24F 40/46* (2020.01); *A24F 40/485* (2020.01); *A24F 40/60* (2020.01); *A24F 40/90* (2020.01)

(58) Field of Classification Search

CPC ..... A24F 40/44
USPC ..... 40/44
See application file for complete search history.

(56) References Cited

U.S. PATENT DOCUMENTS

2014/0290673 A1* 10/2014 Liu ..... A24F 40/485 362/382
2020/0060338 A1 2/2020 Danek
2023/0363448 A1* 11/2023 Xu ..... H01M 50/202

FOREIGN PATENT DOCUMENTS

CN 204232305 U 4/2015
CN 107865462 A 4/2018

(Continued)

*Primary Examiner* — Melvin C. Mayes
(74) *Attorney, Agent, or Firm* — Cheng-Ju Chiang

(57) ABSTRACT

An aerosol generation device includes an atomizer and a power supply device. An atomizing chamber is formed in the atomizer; the power supply device includes a housing, a mounting bracket, and a sensor; the mounting bracket includes a main body, an end cover, and a bottom seat; a control board is disposed in the main body and covers above the sensor; a liquid storage groove configured for collecting e-liquid leaked from the atomizer is formed in the end cover and communicated with the atomizing chamber; the end cover is further provided with an air inlet hole, and the entrance of the air inlet hole is higher than the bottom wall of the liquid storage groove for preventing the leaked e-liquid from entering the sensor through the air inlet hole; a sensor mounting member is sleeved outside the sensor and provided with an air passage communicated with the air inlet hole.

13 Claims, 7 Drawing Sheets

(51) Int. Cl.

| | |
|---|---|
| ***A24F 40/44*** | (2020.01) |
| ***A24F 40/46*** | (2020.01) |
| ***A24F 40/485*** | (2020.01) |
| ***A24F 40/60*** | (2020.01) |
| ***A24F 40/90*** | (2020.01) |

(56) References Cited

FOREIGN PATENT DOCUMENTS

| | | | | | |
|---|---|---|---|---|---|
| CN | 208692313 | U | | 4/2019 | |
| CN | 210124320 | U | | 3/2020 | |
| CN | 212911662 | U | | 4/2021 | |
| EP | 3015010 | A1 | * | 5/2016 | ..... A24F 40/40 |
| WO | 2021/238625 | A1 | | 12/2021 | |

* cited by examiner

AEROSOL GENERATION DEVICE

CROSS-REFERENCE TO RELATED APPLICATIONS

The present disclosure is a continuation-in-part of International Patent Application No. PCT/CN2021/092565, filed on May 10, 2021, which claims priority to Chinese Patent Application No. 202020928409.0, filed on May 27, 2020. All of the aforementioned patent applications are hereby incorporated by reference in their entireties.

TECHNICAL FIELD

The present disclosure relates to the technical field of simulated smoking, in particular to an aerosol generation device.

BACKGROUND

At present, the aerosol generation device includes an atomizer and a power supply device that is electrically connected to the atomizer. When working, the atomizer atomizes the e-liquid under the electric drive of the power supply device to generate smoke for the user to inhale. In order to realize the function that the power supply device can automatically supply power to the atomizer when the user is inhaling, a sensor is installed on the power supply device, and the power supply device supplies power to the atomizer through changes in air pressure sensed by the sensor.

However, the e-liquid leaked in the atomizer or the condensate formed by the cooling of the smoke in the atomizing chamber is easy to leak to the sensor and the control board through the airflow channel between the atomizer and the sensor, thus causing the control board to burn out, and resulting in damage to the power supply device.

SUMMARY

Based on this, it is necessary to provide an aerosol generation device in which the control board is not easily burnt out.

The technical solution adopted by the present disclosure to solve the problem is as follows: an aerosol generation device includes an atomizer and a power supply device electrically connected to the atomizer, wherein an atomizing chamber is provided in the atomizer, the power supply device includes a housing, a mounting bracket partially accommodated in the housing and a sensor detachably installed in the mounting bracket, the mounting bracket includes a main body, an end cover disposed at one end of the main body and a bottom seat disposed at the other end of the main body, a control board is disposed in the main body, the control board covers above the sensor, a liquid storage groove configured for collecting e-liquid leaked from the atomizer is formed in the end cover, the liquid storage groove is located under and communicated with the atomizing chamber, an air inlet hole communicated with the liquid storage groove is formed in the end cover, an entrance of the air inlet hole is higher than a bottom wall of the liquid storage groove for preventing the leaked e-liquid from entering the sensor through the air inlet hole, a sensor mounting member is sleeved on an outside of the sensor, the sensor mounting member is accommodated in the main body, the sensor mounting member is provided with an air passage communicated with the air inlet hole.

Further, the atomizer includes a liquid storage member and a base assembly installed at one end of the liquid storage member, the base assembly includes an atomizing base installed at a lower end of the liquid storage member, an airflow passage is provided in the atomizing base, the airflow passage is communicated with the atomizing chamber and the liquid storage groove.

Further, the base assembly further includes a support sleeve installed on the atomizing base and an atomizing sleeve sleeved on an outside of the support sleeve, a chamber is enclosed jointly by the atomizing sleeve and the supporting sleeve, and the chamber constitutes the atomizing chamber.

Further, an inner space of the liquid storage member forms a liquid storage chamber for storing e-liquid.

Further, the base assembly further includes a first electrode column and a heating structure installed on the atomizing sleeve, there are two first electrode columns, the two first electrode columns are both installed at a lower end of the atomizing base, the heating structure includes a liquid guiding member received in the atomizing chamber and a heating member sleeved on an outside of the liquid guiding member.

Further, the atomizer further includes an upper cover installed at the other end of the liquid storage member relative to the base assembly, a mouthpiece covering on the upper cover and a vent tube accommodated in the liquid storage member, the upper cover is sleeved on an outside of the vent tube.

Further, a top of the mouthpiece is provided with a smoking port, the smoking port is communicated with an inner space of the vent tube.

Further, the power supply device further includes a charging board installed at one end of the mounting bracket away from the sensor.

Further, a light-emitting element is welded on the control board, a lampshade covers above the light-emitting element, the lampshade is connected with the main body by snapping connection.

Further, the end cover is covered by an end cover sealing member, the end cover sealing member is in an interference fit with the housing.

Further, the liquid storage groove is formed by recessing downwards from an upper end surface of the end cover.

Further, the air inlet hole is formed in an inner side wall of the end cover along an axial direction of the end cover.

Further, the atomizer includes a liquid storage member and an atomizing base installed at a lower end of the liquid storage member, an airflow passage is provided in the atomizing base, the airflow passage is communicated between the atomizing chamber and the liquid storage groove, a vent hole is provided in a side wall of the housing, the vent hole is communicated with an inner space of the housing and the airflow passage; when a user sucks, external air enters the atomizing chamber through the vent hole and the airflow passage, and negative pressure is formed in the air inlet hole and the air passage such that the sensor generates a differential pressure signal after sensing a pressure change.

Further, two first magnetic members are installed on the atomizing base, and two second magnetic members are provided on the end cover; when the atomizer is connected to the power supply device, the two first magnetic members are magnetically connected to the two second magnetic members, respectively.

Further, the atomizer includes a heating member, two first electrode columns are installed at the atomizing base, two pins of the heating member are electrically connected to the two first electrode columns, respectively; two second electrode columns are provided on the end cover, the two second electrode columns are electrically connected to the two first electrode columns, respectively.

The beneficial effects of the present disclosure are as follows: in the aerosol generation device provided by the present disclosure, a liquid storage groove is provided in the end cover, the liquid storage groove is communicated with the atomizing chamber, the inner side wall of the end cover is provided with an air inlet hole, the air inlet hole is in communication with the atomizing chamber and the liquid storage groove, and the entrance of the air inlet hole is higher than the bottom wall of the liquid storage groove. Therefore, the e-liquid leaked in the atomizer or the condensate formed by the cooling of the smoke in the atomizing chamber enters the liquid storage groove, the e-liquid or condensate will not flow to the sensor and the control board through the air inlet hole, the control board will not be burned out, and thus the power supply device will not be damaged.

BRIEF DESCRIPTION OF THE DRAWINGS

The following further describes the present disclosure with reference to the accompanying drawings and embodiments.

Figure 1:
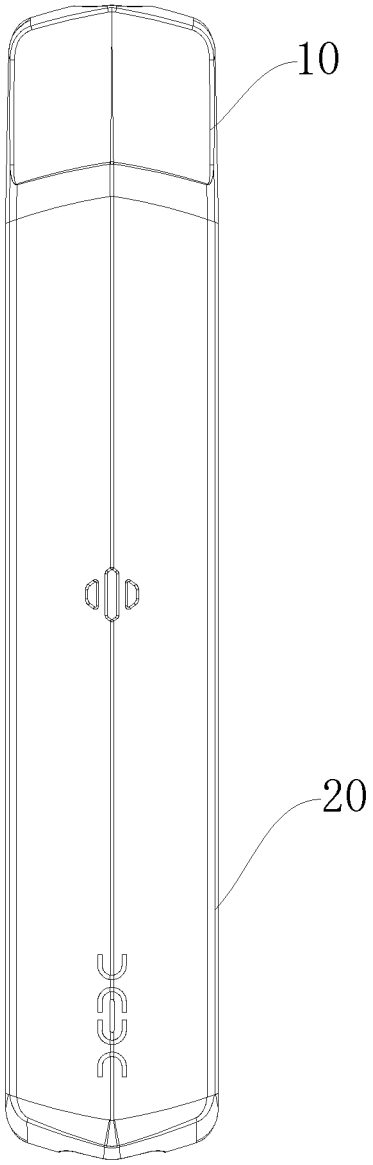
FIG. 1 is a schematic diagram of the aerosol generation device of the present disclosure.

The part names and reference signs shown in the figures are as follows:

| | | |
|---|---|---|
| atomizer 10 | power supply device 20 | liquid storage member 11 |
| base assembly 12 | upper cover 13 | mouthpiece 14 |
| vent tube 15 | liquid storage chamber 111 | atomizing base 121 |
| support sleeve 122 | first electrode column 123 | atomizing sleeve 124 |
| heating structure 125 | first magnetic member 126 | liquid inlet hole 1221 |
| atomizing chamber 1241 | heating member 1251 | airflow passage 1211 |
| smoking port 141 | housing 21 | mounting bracket 22 |
| power supply 23 | sensor 24 | charging board 25 |
| vent hole 211 | main body 221 | end cover 222 |
| bottom seat 223 | control board 2211 | light-emitting element 2212 |
| lampshade 2213 | second magnetic member 224 | receiving groove 225 |
| second electrode column 226 | first through hole 227 | liquid storage groove 228 |
| end cover sealing member 220 | through hole 2201 | second through hole 2202 |
| sensor mounting member 241 | air passage 2411 | air inlet hole 2221 |
| entrance 2222 | | |

DETAILED DESCRIPTION OF PREFERRED EMBODIMENTS

The present disclosure will now be described in detail with reference to the accompanying drawings. These figures are simplified schematic diagrams, which only illustrate the basic structure of the present disclosure in a schematic manner, so they only show the structures related to the present disclosure.

Figure 2:
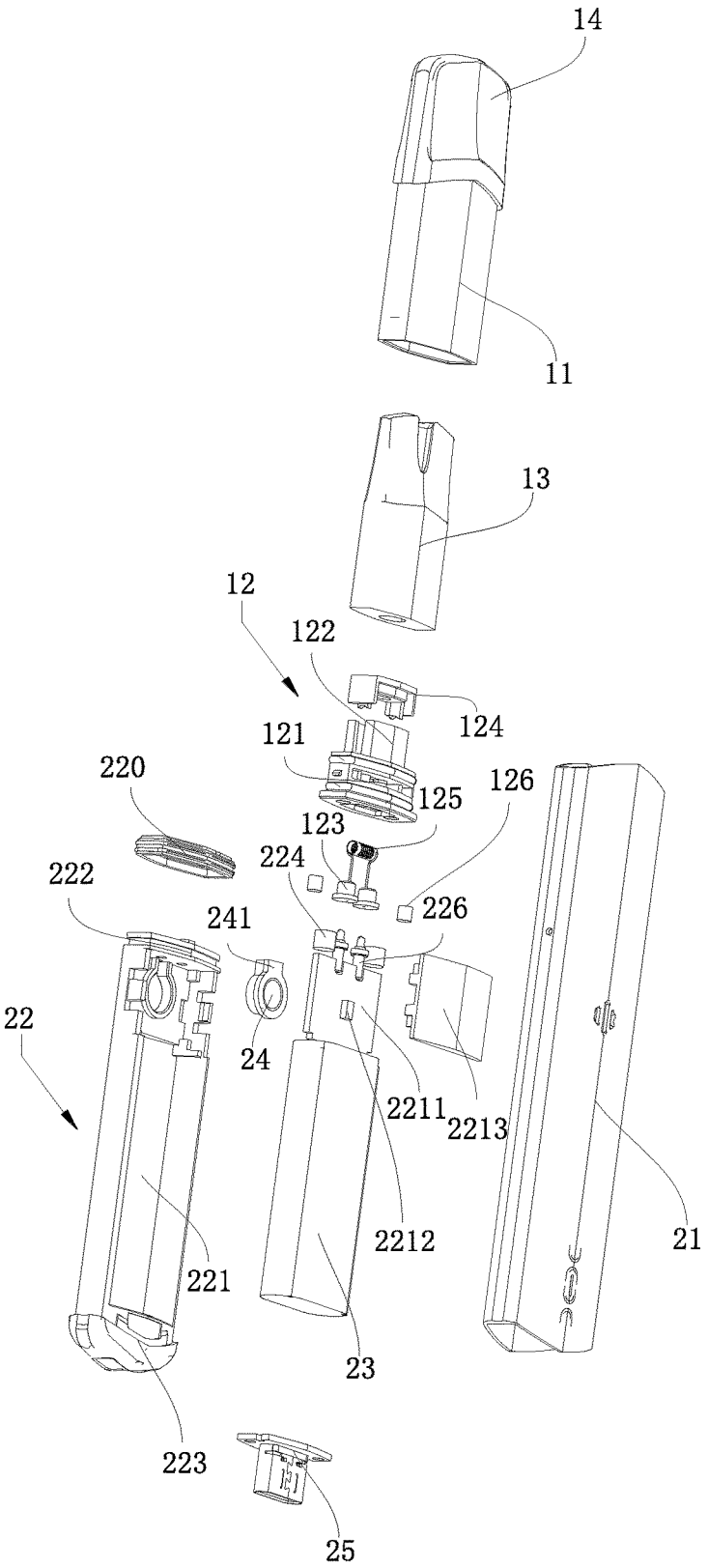
FIG. 2 is an exploded view of the aerosol generation device shown in FIG. 1.
Figure 3:
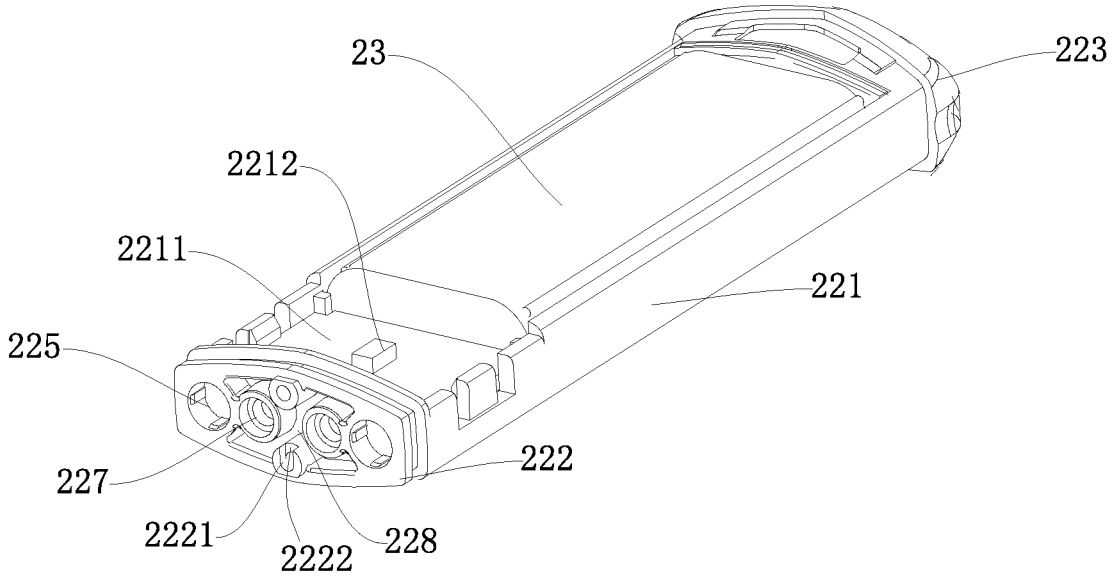
FIG. 3 is a schematic diagram of partial structure of the power supply device of the aerosol generation device shown in FIG. 1.
Figure 4:
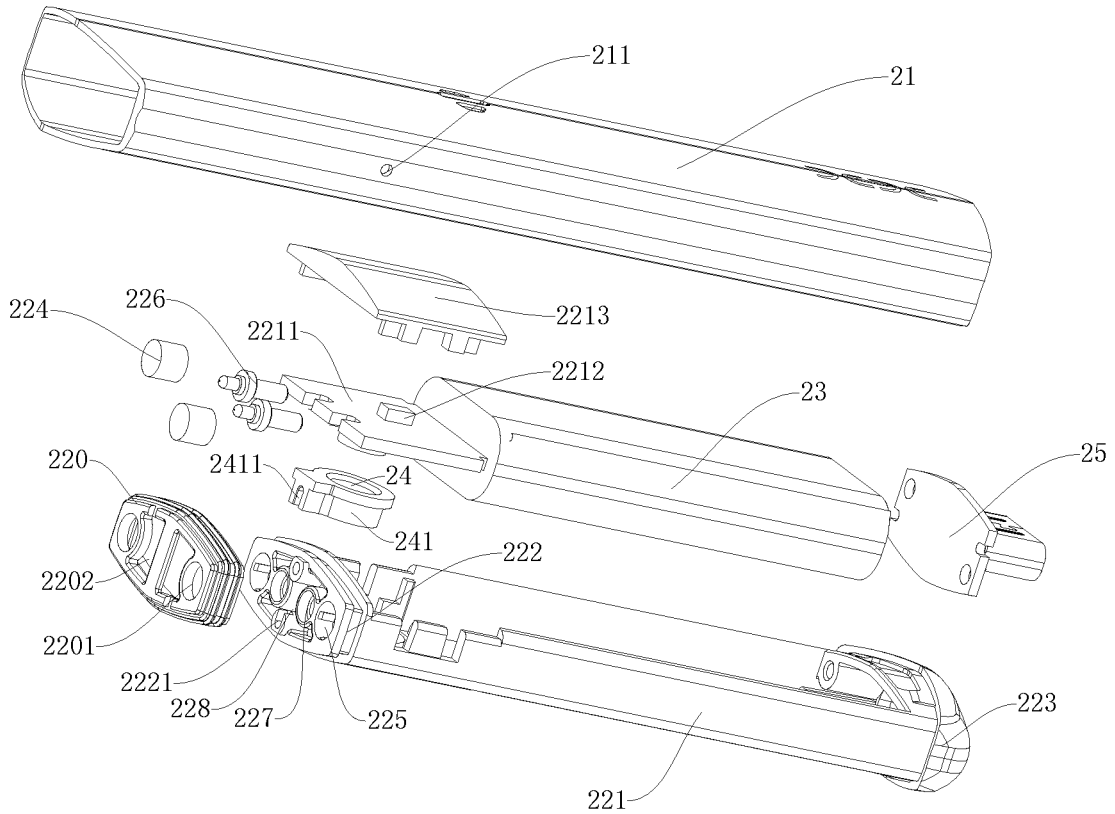
FIG. 4 is an exploded view of the power supply device of the aerosol generation device shown in FIG. 2.
Figure 5:
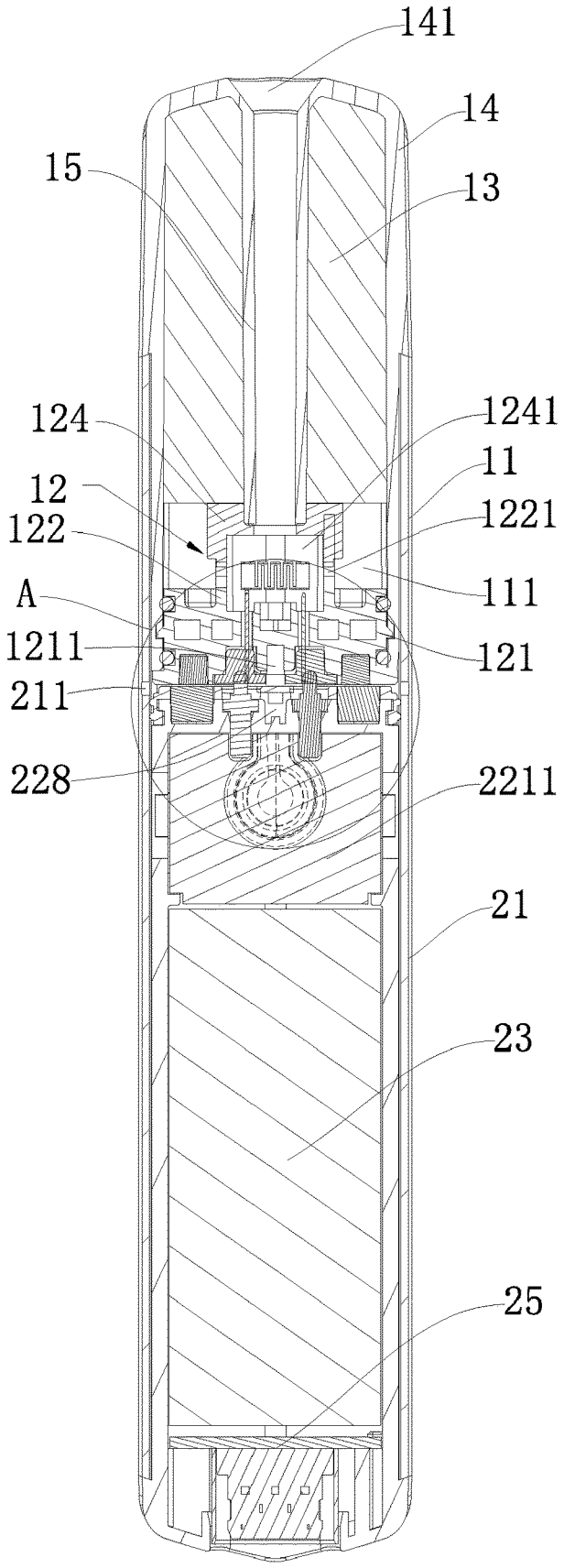
FIG. 5 is a cross-sectional view of the aerosol generation device shown in FIG. 1.
Figure 6:
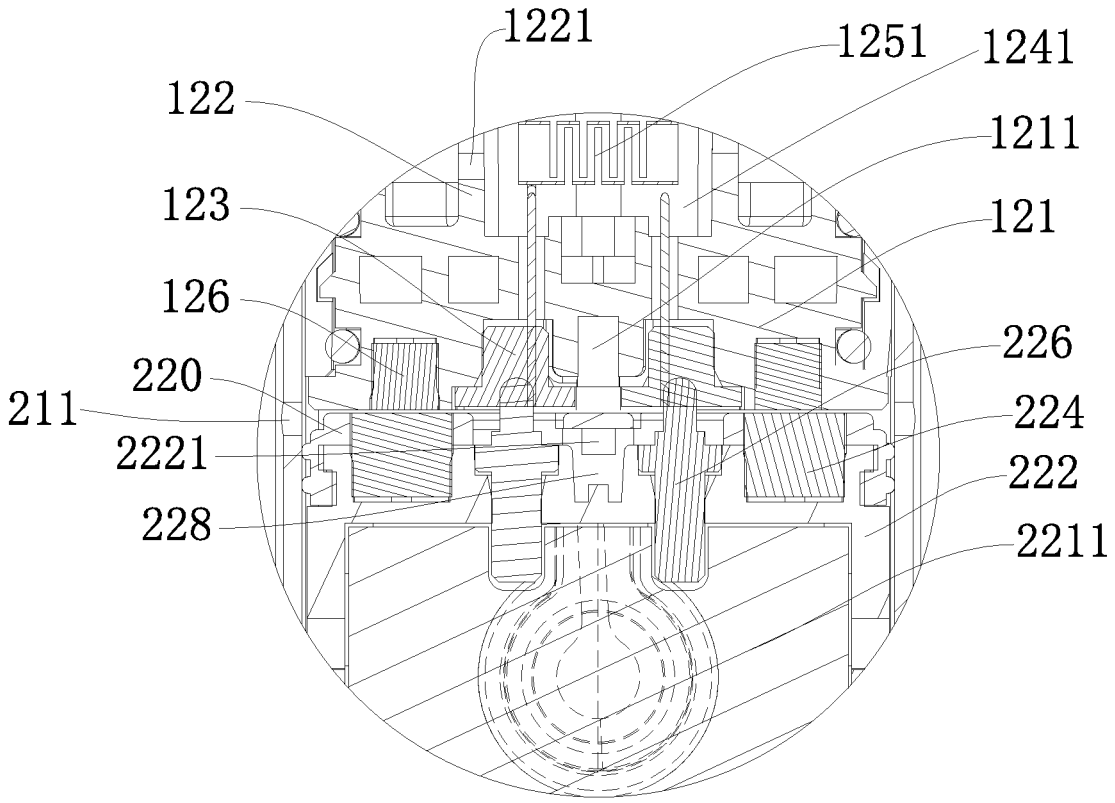
FIG. 6 is a partially enlarged view of the portion A of the aerosol generation device shown in FIG. 5.
Figure 7:
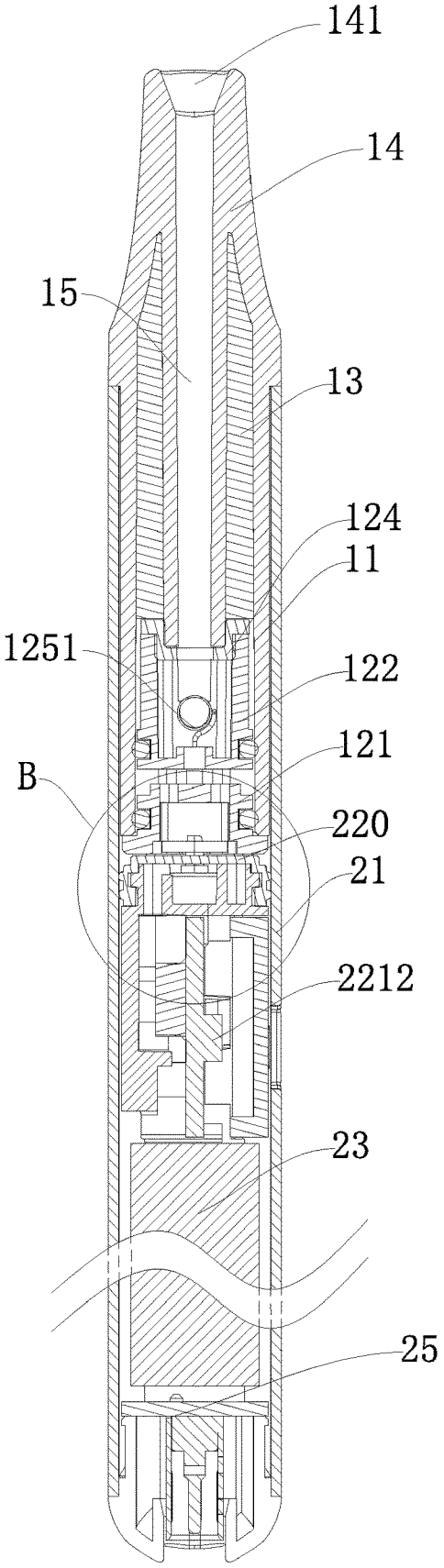
FIG. 7 is another cross-sectional view of the aerosol generation device shown in FIG. 1.
Figure 8:
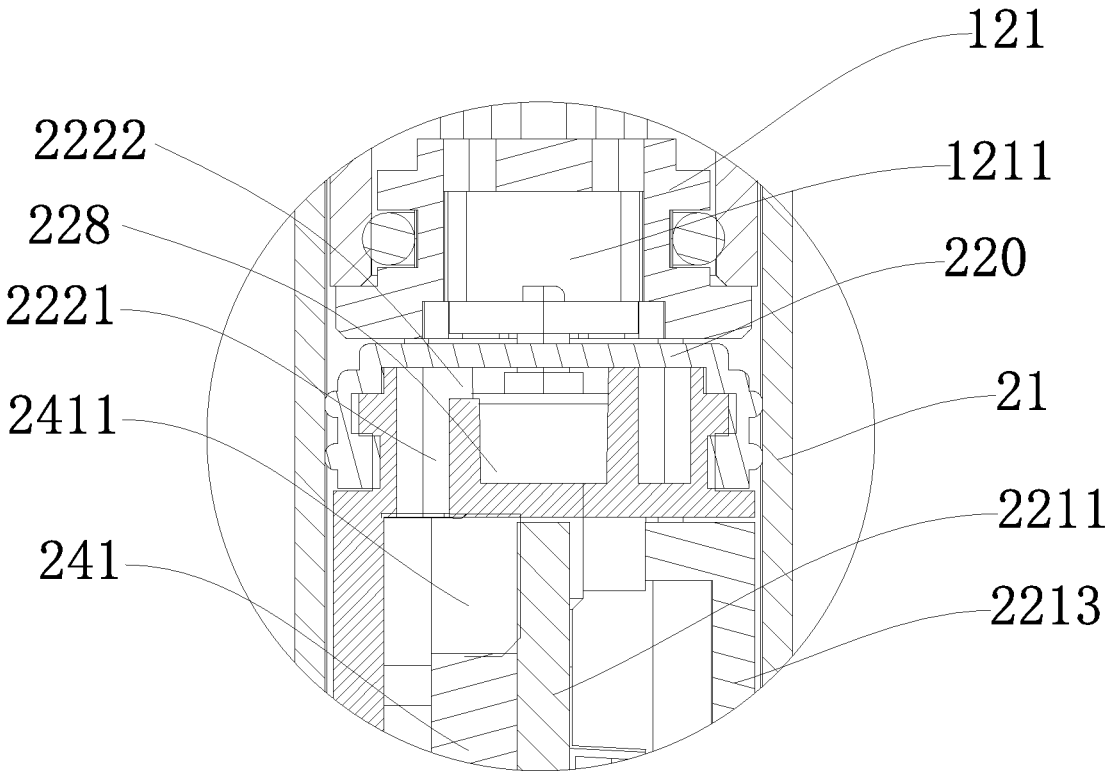
FIG. 8 is a partially enlarged view of the portion B of the aerosol generation device shown in FIG. 7.

Please refer to FIG. 1 to FIG. 2, the present disclosure provides an aerosol generation device, which includes an atomizer 10 and a power supply device 20 electrically connected to the atomizer 10. In use, the power supply device 20 supplies power to the atomizer 10, so that the atomizer 10 works, thereby atomizing the e-liquid to form smoke, and the smoke is for the user to inhale.

Please refer to FIGS. 5 to 8, the atomizer 10 includes a liquid storage member 11, a base assembly 12 installed at one end of the liquid storage member 11, an upper cover 13 installed at the other end of the liquid storage member 11 relative to the base assembly 12, a mouthpiece 14 covering on the upper cover 13, and a vent tube 15 accommodated in the liquid storage member 11.

The liquid storage member 11 is substantially cylindrical with an opening at the lower end thereof. The inner space of the liquid storage member 11 forms a liquid storage chamber 111 for storing e-liquid. It can be understood that the liquid storage member 11 is made of transparent or translucent environmentally friendly plastic material, so that the user can observe the remaining amount of the e-liquid in the liquid storage chamber 111 through the liquid storage member 11.

The base assembly 12 includes an atomizing base 121 installed at the lower end of the liquid storage member 11, a support sleeve 122 and a first electrode column 123 respectively installed on the atomizing base 121, an atomizing sleeve 124 sleeved on the outside of the support sleeve 122, and a heating structure 125 installed on the atomizing sleeve 124.

Further, there are two first electrode columns 123, and the two first electrode columns 123 are both installed at the lower end of the atomizing base 121.

A first magnetic member 126 is further installed on the atomizing base 121. There are two first magnetic members 126, and the two first magnetic members 126 are magnetically connected to the power supply device 20. In this embodiment, the first magnetic member 126 is a magnet.

The support sleeve 122 is substantially cylindrical with two ends being opened. The support sleeve 122 is installed at the upper end of the atomizing base 121. A liquid inlet hole 1221 is provided in the side wall of the support sleeve 122. The atomizing sleeve 124 is substantially cylindrical with two ends being opened. A chamber is enclosed jointly by the atomizing sleeve 124 and the supporting sleeve 122, and the chamber constitutes the atomizing chamber 1241. The liquid inlet hole 1221 is communicated with the atomizing chamber 1241. The heating structure 125 includes a liquid guiding member (not shown) received in the atomizing chamber 1241 and a heating member 1251 sleeved on the outside of the liquid guiding member. One pin of the heating member 1251 is electrically connected to one of the first electrode columns 123, and another pin of the heating member 1251 is electrically connected to the other one of the first electrode columns 123.

In this embodiment, the heating member 1251 is a heating wire, the liquid guiding member is made of cotton. It can be understood that in other unshown embodiments, the heating member 1251 can also be a heating element, such as a heating tube, a heating sheet, or the like, that can generate heat after being energized. The liquid guiding member can also be made of fiber rope, porous ceramics, porous graphite and other materials that have the ability to absorb e-liquid.

Further, an airflow passage 1211 is further provided in the atomizing base 121, and the airflow passage 1211 is located under and communicated with the atomizing chamber 1241.

In this embodiment, the upper end surface of the support sleeve 122 and the lower end surface of the atomizing sleeve 124 are both provided with openings (not labelled). When the atomizing sleeve 124 is sleeved on the outside of the support sleeve 122, the two openings cooperate with each other to form a through hole, and the through hole is communicated with the atomizing chamber 1241.

The mouthpiece 14 is substantially cylindrical with an opening at the lower end. The mouthpiece 14 is clamped with the liquid storage member 11. The top of the mouthpiece 14 is provided with a smoking port 141, the smoking port 141 is communicated with the inner space of the vent tube 15, so that the smoking port 141 is communicated with the atomizing chamber 1241, to realize that when the user is inhaling, the smoke is sucked by the user through the smoking port 141.

The vent tube 15 has a tubular structure with two ends being opened. The vent tube 15 is received in the liquid storage chamber 111, the lower end of the vent tube 15 is connected with the atomizing sleeve 124 and communicated with the atomizing chamber 1241, and the upper end of the vent tube 15 is connected to the liquid storage member 11. The inner space of the vent tube 15 and the atomizing chamber 1241 together constitute a smoke outlet channel (not labelled).

The upper cover 13 has a columnar structure with two ends being opened. The upper cover 13 is sleeved on the outside of the vent tube 15. On the one hand, the upper cover 13 has a certain fixing effect on the vent tube 15, and on the other hand, the upper cover 13 has a sealing effect on the liquid storage chamber 111.

Referring to FIGS. 3 to 8, the power supply device 20 includes a housing 21, a mounting bracket 22 partially accommodated in the housing 21, a power supply 23 and a sensor 24 detachably installed in the mounting bracket 22, and a charging board 25 installed at one end of the mounting bracket 22 away from the sensor 24.

In this embodiment, the mounting bracket 22 and the housing 21 are connected by plugging. In other embodiments not shown, the mounting bracket 22 and the housing 21 may also be connected by snapping connection or magnetic connection.

The housing 21 has a hollow cylindrical structure with two ends being opened. A vent hole 211 is provided in the side wall of the housing 21, and the vent hole 211 is communicated with the inner space of the housing 21 and the airflow passage 1211.

The mounting bracket 22 includes a main body 221, an end cover 222 disposed at one end of the main body 221, and a bottom seat 223 disposed at the other end of the main body 221. The power supply 23 and the sensor 24 are detachably installed in the main body 221. The charging board 25 is accommodated in the bottom seat 223.

A control board 2211 is disposed in the main body 221. The control board 2211 is electrically connected to the power supply 23 and the sensor 24, and the control board 2211 covers above the sensor 24. A light-emitting element 2212 is welded on the control board 2211. In this embodiment, the light-emitting element 2212 is an LED.

Further, a lampshade 2213 covers above the light-emitting element 2212, and the lampshade 2213 is connected with the main body 221 by snapping connection.

A second magnetic member 224 is provided on the end cover 222. The second magnetic member 224 has two, and the two second magnetic members 224 are magnetically connected to the two first magnetic members 126. In order to install the second magnetic member 224, the end cover 222 is provided with a receiving groove 225 for partially receiving the second magnetic member 224. There are two receiving grooves 225, and each second magnetic member 224 is corresponding to a receiving groove 225.

A second electrode column 226 is further provided on the end cover 222. The second electrode column 226 has two, and the two second electrode columns 226 are electrically connected to the two first electrode columns 123. Specifically, the end cover 22 is provided with a first through hole 227 through which the second electrode column 226 can pass. The first through hole 227 has two, and the two first through holes 227 are disposed between the two receiving grooves 225.

Further, a liquid storage groove 228 is formed in the end cover 222 by recessing downward from the upper end surface of the end cover 222. The liquid storage groove 228 is communicated with the atomizing chamber 1241, and the liquid storage groove 228 is located under the atomizing chamber 1241, wherein the airflow passage 1211 is communicated between the atomizing chamber 1241 and the liquid storage groove 228. The liquid storage groove 228 is provided to collect the e-liquid leaked from the atomizer 10, so that the leaked e-liquid will not enter the sensor 24.

The end cover 222 is covered by an end cover sealing member 220. The end cover sealing member 220 is in an interference fit with the housing 21. A through hole 2201 corresponding to the second magnetic member 224 is provided in the end cover sealing member 220. In this embodiment, the upper end surface of the second magnetic member 224 is coplanar with the upper end surface of the end cover sealing member 220. The end cover sealing member 220 is provided with a second through hole 2202 through which the second electrode column 226 can pass. In this embodiment, the end cover sealing member 220 is made of silicone.

A sensor mounting member 241 is sleeved on the outside of the sensor 24. The sensor mounting member 241 is accommodated in the main body 221. An air passage 2411 is provided in the sensor mounting member 241. An air inlet hole 2221 communicated with the air passage 2411 is formed in the inner side wall of the end cover 222 along the axial direction of the end cover 222. The air inlet hole 2221 is in communication with the airflow passage 1211 and the liquid storage groove 228, and the entrance 2222 of the air inlet hole 2221 is higher than the bottom wall of the liquid storage groove 228. Through the negative pressure generated in the air inlet hole 2221, the sensor 24 can generate a differential pressure signal after sensing the pressure change.

In this embodiment, the sensor 24 is an air pressure sensor. It can be understood that, in other embodiments not shown, the sensor 24 can also be an airflow sensor.

When the user sucks, negative pressure is formed in the air inlet hole 2221 and the air passage 2411, the sensor 24 generates a differential pressure signal after sensing the pressure change, and transmits the differential pressure signal to the control board 2211; after receiving the differential pressure signal, the control board 2211 controls the control power supply 23 to supply power to the second electrode columns 226 and the first electrode columns 123, so that the heating member 1251 is energized and heated. At the same time, the external air enters the atomizing chamber 1241 through the vent hole 211 and the airflow passage 1211, such that the smoke formed by heating the e-liquid in the atomizing chamber 1241 by the heating member 1251 enters the user's mouth through the smoking port 141 after passing through the smoke outlet channel and the inner space of the mouthpiece 14.

In the aerosol generation device provided by the present disclosure, a liquid storage groove 228 is provided in the end cover 222, the liquid storage groove 228 is communicated with the atomizing chamber 1241, the inner side wall of the end cover 222 is provided with an air inlet hole 2221, the air inlet hole 2221 is in communication with the atomizing chamber 1241 and the liquid storage groove 228, and the entrance 2222 of the air inlet hole 2221 is higher than the bottom wall of the liquid storage groove 228. Therefore, the e-liquid leaked in the atomizer 10 or the condensate formed by the cooling of the smoke in the atomizing chamber 1241 enters the liquid storage groove 228, the e-liquid or condensate will not flow to the sensor 24 and the control board 2211 through the air inlet hole 2221, the control board 2211 will not be burned out, and thus the power supply device 20 will not be damaged.

Taking the above-mentioned ideal embodiments according to the present disclosure as enlightenment, through the above description, the relevant persons can make various changes and modifications without departing from the concept of the present disclosure. The technical scope of the present disclosure is not limited to the content of the specification, and its technical scope should be determined according to the scope of the claims.

What is claimed is:

1. An aerosol generation device comprising an atomizer and a power supply device electrically connected to the atomizer, wherein an atomizing chamber is provided in the atomizer, the power supply device comprises a housing, a mounting bracket partially accommodated in the housing and a sensor detachably installed in the mounting bracket, the mounting bracket comprises a main body, an end cover disposed at one end of the main body and a bottom seat disposed at the other end of the main body, the end cover is a topmost portion of the mounting bracket and configured for connecting with the atomizer, a control board is disposed in the main body, the control board covers above the sensor, a liquid storage groove configured for collecting e-liquid leaked from the atomizer is formed in the end cover, the liquid storage groove is formed by recessing downwards from an upper end surface of the end cover that faces the atomizer, the liquid storage groove is located under and communicated with the atomizing chamber, an air inlet hole communicated with the liquid storage groove is formed in the end cover, the air inlet hole is formed in an inner side wall of the end cover along an axial direction of the end cover, wherein the liquid storage groove is centrally located in the end cover, and the air inlet hole is located on a lateral side of the liquid storage groove, an entrance of the air inlet hole is higher than a bottom wall of the liquid storage groove for preventing the leaked e-liquid from entering the sensor through the air inlet hole, a sensor mounting member is sleeved on an outside of the sensor, the sensor mounting member is accommodated in the main body, the sensor mounting member is provided with an air passage communicated with the air inlet hole.

2. The aerosol generation device according to claim 1, wherein the atomizer comprises a liquid storage member and a base assembly installed at one end of the liquid storage member, the base assembly comprises an atomizing base installed at a lower end of the liquid storage member, an airflow passage is provided in the atomizing base, the airflow passage is communicated with the atomizing chamber and the liquid storage groove.

3. The aerosol generation device according to claim 2, wherein the base assembly further comprises a support sleeve installed on the atomizing base and an atomizing sleeve sleeved on an outside of the support sleeve, a chamber is enclosed jointly by the atomizing sleeve and the supporting sleeve, and the chamber constitutes the atomizing chamber.

4. The aerosol generation device according to claim 2, wherein an inner space of the liquid storage member forms a liquid storage chamber for storing e-liquid.

5. The aerosol generation device according to claim 3, wherein the base assembly further comprises a first electrode column and a heating structure installed on the atomizing sleeve, there are two first electrode columns, the two first electrode columns are both installed at a lower end of the atomizing base, the heating structure comprises a liquid guiding member received in the atomizing chamber and a heating member sleeved on an outside of the liquid guiding member.

6. The aerosol generation device according to claim 2, wherein the atomizer further comprises an upper cover installed at the other end of the liquid storage member relative to the base assembly, a mouthpiece covering on the upper cover and a vent tube accommodated in the liquid storage member, the upper cover is sleeved on an outside of the vent tube.

7. The aerosol generation device according to claim 6, wherein a top of the mouthpiece is provided with a smoking port, the smoking port is communicated with an inner space of the vent tube.

8. The aerosol generation device according to claim 1, wherein the power supply device further comprises a charging board installed at one end of the mounting bracket away from the sensor.

9. The aerosol generation device according to claim 1, wherein a light-emitting element is welded on the control board, a lampshade covers above the light-emitting element, the lampshade is connected with the main body by snapping connection.

10. The aerosol generation device according to claim 1, wherein the end cover is covered by an end cover sealing member, the end cover sealing member is in an interference fit with the housing.

11. The aerosol generation device according to claim 1, wherein the atomizer comprises a liquid storage member and an atomizing base installed at a lower end of the liquid storage member, an airflow passage is provided in the atomizing base, the airflow passage is communicated between the atomizing chamber and the liquid storage groove, a vent hole is provided in a side wall of the housing, the vent hole is communicated with an inner space of the housing and the airflow passage; when a user sucks, external air enters the atomizing chamber through the vent hole and the airflow passage, and negative pressure is formed in the air inlet hole and the air passage such that the sensor generates a differential pressure signal after sensing a pressure change.

12. The aerosol generation device according to claim 11, wherein two first magnetic members are installed on the atomizing base, and two second magnetic members are provided on the end cover; when the atomizer is connected to the power supply device, the two first magnetic members are magnetically connected to the two second magnetic members, respectively.

13. The aerosol generation device according to claim 12, wherein the atomizer comprises a heating member, two first electrode columns are installed at the atomizing base, two pins of the heating member are electrically connected to the two first electrode columns, respectively; two second electrode columns are provided on the end cover, the two second electrode columns are electrically connected to the two first electrode columns, respectively.

* * * * *